US010718140B1

(12) United States Patent
Karapetyan et al.

(10) Patent No.: US 10,718,140 B1
(45) Date of Patent: Jul. 21, 2020

(54) CABINET LOCKING DEVICE

(71) Applicants: Tigran Karapetyan, Los Angeles, CA (US); Armen Karapetyan, Los Angeles, CA (US)

(72) Inventors: Tigran Karapetyan, Los Angeles, CA (US); Armen Karapetyan, Los Angeles, CA (US)

( * ) Notice: Subject to any disclaimer, the term of this patent is extended or adjusted under 35 U.S.C. 154(b) by 149 days.

(21) Appl. No.: 15/932,815

(22) Filed: Apr. 30, 2018

(51) Int. Cl.

| | |
|---|---|
| ***E05C 3/04*** | (2006.01) |
| ***E05B 35/00*** | (2006.01) |
| *E05C 5/02* | (2006.01) |
| *E05B 65/00* | (2006.01) |

(52) U.S. Cl.
CPC ..... *E05C 3/041* (2013.01); *E05B 35/008* (2013.01); *E05B 65/0014* (2013.01); *E05C 5/02* (2013.01)

(58) Field of Classification Search
CPC .... E05B 35/008; E05B 65/0014; E05B 65/06; E05B 65/08; E05B 2065/0805; E05C 3/02; E05C 3/04; E05C 3/041; E05C 3/042; E05C 3/043; E05C 3/044; E05C 3/045; E05C 3/046; E05C 3/047; E05C 3/048; E05C 5/00; E05C 2005/005; E05C 5/02; E05C 5/04
USPC ..... 292/206, 105, 147, 149, 155, 176, 212, 292/251; 312/215, 333
See application file for complete search history.

(56) References Cited

U.S. PATENT DOCUMENTS

| | | | | | |
|---|---|---|---|---|---|
| 410,115 | A * | 8/1889 | Reed | E05F 11/00 | 292/206 |
| 910,283 | A * | 1/1909 | Gerst | E05C 19/18 | 292/206 |
| 1,550,181 | A * | 8/1925 | Pressler | E05C 3/045 | 292/206 |
| 2,092,395 | A * | 9/1937 | Hill | E05C 3/043 | 292/206 |
| 4,418,951 | A * | 12/1983 | Schultz | E05C 3/041 | 292/202 |
| 6,296,431 | B1 * | 10/2001 | Miller | F16B 5/0208 | 411/107 |
| 6,568,226 | B1 * | 5/2003 | Ramsauer | E05B 17/0025 | 292/114 |
| 6,695,507 | B1 * | 2/2004 | Waguespack | B41J 29/54 | 292/137 |
| 9,377,037 | B2 * | 6/2016 | Daniels | F16B 2/16 | |
| 2017/0037661 | A1 * | 2/2017 | Tessier | E05B 77/34 | |
| 2019/0107139 | A1 * | 4/2019 | Hodsdon | F16B 5/0241 | |

* cited by examiner

*Primary Examiner* — William V Gilbert

(57) ABSTRACT

A cabinet locking device prevents undesirable movement of the cabinet drawer or pivotably swinging cabinet door from a closed position to an opened position relatively to the cabinet stationary base. The cabinet locking device includes a screw busing, comprising a an inner and outer threads and a spline, and a locking member, comprising an extended portion, which includes an outer thread, and a locking member head, which includes a first and second projections.

3 Claims, 9 Drawing Sheets

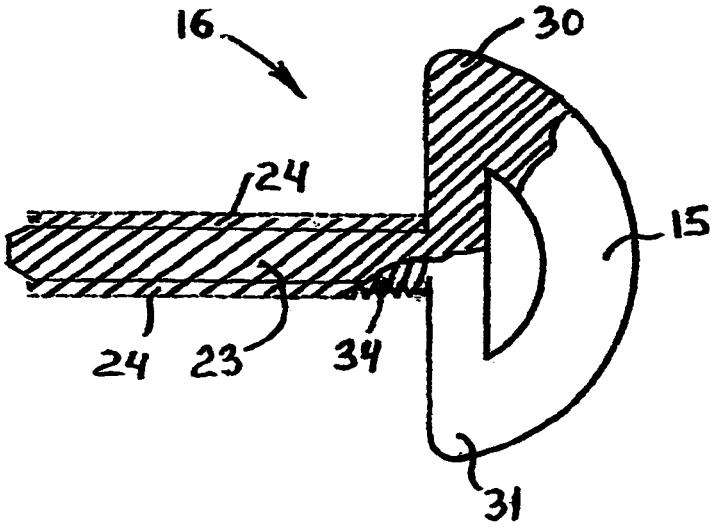
FIG. 7A
FIG. 7B
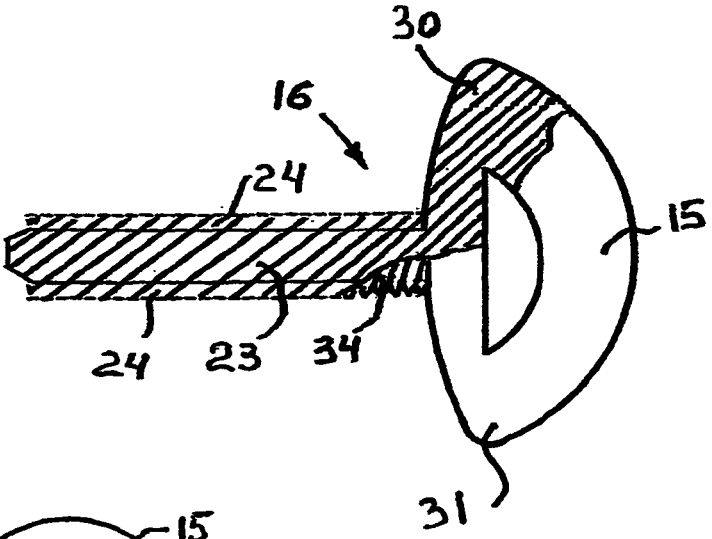
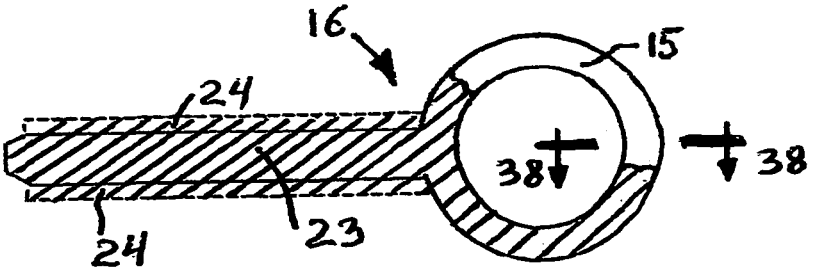
FIG. 7C
38-38
FIG. 7D
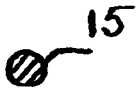

CABINET LOCKING DEVICE

PATENT NUMBERS (PRIOR ART) CITED IN THE SPECIFICATION

1. U.S. Pat. No. 3,437,365
2. U.S. Pat. No. 3,973,420
3. U.S. Pat. No. 5,647,618
4. U.S. Pat. No. 6,568,226
5. U.S. Pat. No. 6,695,507
6. U.S. Pat. No. 6,874,825
7. U.S. Pat. No. 6,908,545
8. U.S. Pat. No. 8,152,208
9. U.S. Pat. No. 9,938,757

FIELD OF INVENTION

The invention relates to the cabinet locking devices. More specifically, invention relates to the cabinet door locking devices, which do not require the use of any additional cabinet door latches for securing cabinet door(s) in the closed position.

BACKGROUND OF INVENTION

The cabinet locking devices are intended for cabinets, having the door (panel) mounted for movement on the cabinet stationary base. Generally, most known cabinet locks have two portions: one portion of the cabinet door locking devices is coupled to the cabinet doors and another portion of the cabinet door locking devices is coupled to the cabinet stationary base. The pivotable cabinet door (pivotally movable door panel) provides blockage (cover) of the opening in the cabinet stationary base. The cabinet door(s) are intended for swinging movement relative to the cabinet between opened and closed positions. The cabinet locking devices secure the closed position of the cabinet's door (panel).

Many different cabinet locking devices are very well known. Some cabinet locking devices have the magnetic locking (latch) mechanisms or the clipping latch mechanisms, containing two portions, one of which is connected to the interior surface of the cabinet door at the door edge area, and another portion is connected to the edge of the cabinet base's opening.

For example the latch mechanism by U.S. Pat. No. 5,647,618 uses a clipping mechanism and includes a cleat, a mounting guide and a clip. The cleat is coupled to the door, while the mounting guide with the clip is fixedly coupled to the cabinet. When cleat and clip are in their latched position, then door is closed.

The cleat includes a base or mounting plate with a pair of mounting holes, a pair of latching elements extending from mounting plate and a safety tab also extending from mounting plate. The cleat is constructed as a one-piece, unitary member. Cleat can be mounted to door or by a pair of screws or by a conventional adhesive of sufficient strength such that person could not break the adhesive to disable latch mechanism. Latching elements extend outwardly from the flat mounting plate and are L-shaped members. Latching elements are spaced from each other by a predetermined distance to allow a portion of clip to enter therebetween for latching cleat to clip. Each of the latching elements has a first latch portion, extending substantially perpendicularly from mounting plate, and a second latch portion extending substantially parallel to mounting plate. Second portions of each of the latching elements extend towards each other such that latching elements are mirror images of each other about a horizontal center plane of mounting plate. Each of the second portions of latching elements has a latching surface and a ramping surface. Latching surfaces are intended to engage clip to cleat. Safety tab is positioned between latching elements so as to provide an added measure of safety to latch mechanism. Generally, the safety tab is integrally coupled to mounting plate by a living hinge located between latching elements. Safety tab is formed to extend outwardly from mounting plate at an angle so that the free end of safety tab is located close to second latch portions of latching elements to prevent inadvertent uncoupling of the clip from cleat. Also, safety tab can be made to initially lie in the same plane as base, and then subsequently permanently deformed or modified by deflecting or bending safety tab outwardly, until safety tab permanently yields to an angulated position adjacent to second portions of latching elements. When safety tab is in its angulated position and clip is coupled to cleat, clip cannot be unlatched from cleat without applying pressure to safety tab to move it out of the way of clip. The safety tab can be moved from its angulated position to a second position wherein safety tab lies substantially in the same plane of mounting plate for permitting clip to be unlatched from cleat. Upon releasing pressure from safety tab, safety tab will spring back to its original angulated position.

The mounting guide has a tubular body portion for slidably receiving clip therein, and a mounting plate or flange with a pair of mounting holes formed therein for fixedly coupling mounting guide to cabinet via a pair of screws. The body portion includes a guide web dividing the tubular body portion into two equally sized guide cavities, which are the rectangular bores intended to slidably receive portions of clip therein. Tubular body portion also includes an integrally molded guide catch for coupling clip to mounting guide for a limited predetermined range of movement. The guide catch is located on the opposite side of body portion. Guide catch has an arm portion extending parallel to the longitudinal axis of guide cavities and a rib portion extending inwardly into one of the guide cavities from the free end of arm portion. Arm portion is resiliently coupled to tubular body portion so that rib portion can be resiliently deflected out of upper guide cavity, in order the clip to be either coupled to mounting guide or removed from mounting guide.

The resiliency of arm portion of guide catch is due to the reduced thickness of arm portion relative to the remainder of mounting guide. The arm portion is approximately half the thickness of the wall of tubular body portion such that tubular body portion is rigid and inflexible. At the same time, the guide catch is resiliently movable relative to body portion via arm portion. Turning now to FIGS. 19-22, clip 24 is illustrated as being an integrally formed, one-piece, unitary member out of a plastic material.

Clip also includes a rectangular body portion, a pair of release arms extending from opposite ends of body portion and a pair of hook-shaped latching elements extending inwardly towards each other from release arm. The clip is slidably mounted within guide and releasably coupled to cleat for selectively locking enclosure 12. Body portion is divided into a pair of block members by a guide slot. The upper block member has a guide catch slot formed in one of its surfaces for slidably receiving guide catch therein. The guide catch slot is opened at its rearward end of body portion. The guide catch slot has a stop surface for engaging rib portion of guide catch. Rib portion of guide catch cooperates with stop surface of guide catch slot for limiting the rearward movement of clip relative to mounting guide. Forward movement of clip relative to mounting guide is limited by a stop surface formed in guide web slot. The stop surface of guide web slot engages the rear surface of guide web to limit the forward movement of body portion within guide cavities of mounting guide. The release arms are integrally formed at the top and bottom rearward corners of body portion and extend forwardly to form a pair of lever arms resiliently coupled to body portion. Each of the latching elements includes a connecting member extending perpendicularly inwardly from its respective release arm. Connecting members are spaced inwardly from the free ends of release arms in the manner that latching elements do not extend farther out than release arms.

The major deficiency of such cabinet locking devices is: they contain two portions needed to be precisely positioned relatively each other for efficient clipping action and complex. Also, the lock requires the resiliently compressible-pullable manual actions, which may be not conveniently possible for the elderly or ill persons.

Another well-known locking devices are based on the strapping principles for locking a movable (swinging) door (panel) to a relatively cabinet stationary base. For example, the lock by the one of the most recent modern patents (U.S. Pat. No. 9,938,757) includes a base mount, a tether holder, and a panel tether. Base mount is adapted to be mounted on a base of a cabinet, or other relatively stationary structure. Tether holder is adapted to be mounted on a movable panel (door) such as a swinging door. Panel tether is permanently coupled to base mount and configured to be engaged to and disengaged from tether holder at the option of a caregiver or other door-lock user. Panel tether includes a strap and a strap anchor. Strap anchor is configured to be engaged temporarily to tether holder by a user to lock door lock. Strap anchor is also configured to be disengaged from tether holder by a user. Strap has one end coupled to base mount and another end coupled to strap anchor. Strap anchor of panel/door tether includes the movable latches and a movable lift tab. The latches are mounted for swinging movement away from one another to engage tether holder and toward one another to disengage tether holder. The lift tab is mounted for pivotable movement toward tether holder to engage a tab receiver formed in tether holder and away from tether holder to disengage tab receiver formed in tether holder. Tether holder includes a retainer-support plate. Retainer-support plate is adapted to be mounted on a movable panel and formed to include a tab receiver that is arranged to mate with lift tab included in strap anchor of panel tether. Anchor retainer is arranged to mate with the latches included in strap anchor of panel tether. To unlock door lock, a caregiver must apply squeezing forces to first and second squeeze buttons associated with first and second spring-loaded slidable latches included in strap anchor and then apply a lifting force to a spring-loaded pivotable lift tab included in strap anchor. Latch-biasing spring provides means for moving first and second latches away from one another to cause a first squeeze button provided on a near end of first latch to project outwardly in a direction through a first side aperture formed in latch housing and to cause a second squeeze button provided on a far end of second latch to project outwardly in an opposite direction through a second side aperture formed in latch housing.

Lift tab includes a finger grip and a motion-blocking tang cantilevered to an inwardly facing surface of finger grip. Lift tab also includes a first support arm coupled to one side of finger grip and a second support arm coupled to another side of finger grip. Lift tab is mounted on latch housing for pivotable movement about a tab-pivot axis between an extended position and a withdrawn position. Latch housing includes a hollow base and a base closure adapted to be mounted on top of hollow base to cover the slidable first and second latches that extend into an interior region bounded by hollow base and base closure. Base is formed to include first and second apertures that open into interior region. Spring-support post is coupled to a floor of hollow base and arranged to support latch-biasing spring in interior region of latch housing. Hollow base also includes a lift-tab channel flanked by first and second pad-support platforms and sized to receive motion-blocking tang of lift tab therein. Latch housing also includes a first tab-mount pad coupled to a free end of first support arm of lift tab and a second tab-mount pad coupled to a free end of second elastic support arm of lift tab. First tab-mount pad is configured to mate with first pad-support platform of the base. Second tab-mount pad is configured to mate with second pad-support platform of the base.

The most important deficiencies are: the locking devises by this patent require the precise distance positioning of the tether holder and the base mount in order that the strapping portion (panel tether) will be able to properly provide movement toward one another to engage the locking action or away from one another to disengage the unlocking action. Also, the locking device requires the resiliently compressible-pullable manual actions, which may be not conveniently possible for the elderly or ill persons.

The other known cabinet door locking devices by the U.S. Pat. Nos. 3,437,365; 3,973,420 and 6,874,825 have a locking assembly attached to the stationary base.

For instance, the cabinet lock by the U.S. Pat. No. 3,437,365 includes a spring clip for attaching the lock to the edge of the cabinet stationary base opening intended to be covered by the cabinet door and latch member. The latch member includes a shank and a latch bar. The latch bar extends radially from the shank and perpendicular to the center line of the shank. The spring clip includes a teeth, which prevents the lock from slipping off the cabinet opening edge. The latch shank with the latch bar is coupled with the facing section via the bolt to the nut, rigidly connected (e.g., welded) to the facing section. The bolt passes through the head of the latch member into the shank. The lock is installed on the opening edge by slipping the spring clip of the lock over the edge of the opening. For this purpose the spring section includes the specifically bended gripping section.

The most important deficiencies are: such locks are complex and their installation onto the opening edge is unsecured. Also, the lock requires the resiliently compressible-pullable members (springs) or manual actions, which may be not conveniently possible for elderly or ill persons, and is complex too.

The cabinet lock by U.S. Pat. No. 3,973,420 is intended to be attached to vertical side of the cabinet walls, and includes a base or mounting plate adapted to be placed against the exterior of the cabinet side wall in the available space forwardly of the wall. The mounting plate is equipped during manufacture with a pair of threaded through openings which are vertically spaced when the lock is in the normal installed position and located near the leading vertical edge of the mounting plate. The mounting plate is used as a template to assist the home owner in drilling a pair of holes in the cabinet side wall which will register with the threaded openings and receive a pair of lock mounting screws. The mounting arrangement is intended for cabinets having relatively thick side walls. The lock assembly further comprises a pair of spaced parallel guide and retainer bars extending at right angles to the mounting plate and having their inner ends rigidly secured thereto. The bars extend away from the cabinet wall at right angles thereto for sufficient distances to accommodate the necessary movement of a lock body supported and guided thereon. The lower bar is provided on one side thereof with a series of equidistantly spaced locking notches or detents. The bars are equipped near their outer ends with retainer rings to prevent the complete separation of the lock body therefrom and thus preventing separation and loss of parts of the lock. The lock body is a block-like body elongated in the direction between the two bars. It is bored through near its rear vertical side and near its top and bottom with a pair of bores for the slidable reception of the bars, on which the lock body is movable toward and away from the cabinet wall. The lock body contains a key operable turnable lock cylinder whose key slot is exposed at the upper end of the lock body during normal usage. The cylinder is received in a blind bore formed in one end of the lock body. The cylinder is equipped with conventional tumblers. The tumblers are each biased by a small spring into a keyway or groove which prevents rotation of the cylinder (plug) prior to entry through the slot of a properly designed key. The cylinder is bodily retained in the bore by a conventional retainer ring which snaps into a groove when the cylinder is inserted into the bore, and the cylinder has the spline slidably contacting a spring urged shoe secured integrally with a locking tooth, operating in a cross guideway of the lock body. With the proper key inserted in the slot to release all of the tumblers, the cylinder may be turned in the lock body, and when this occurs, the coaction of spline against shoe will retract the locking tooth from the particular detent notch of the lock retainer bar. The tooth is biased by a spring toward locking engagement with the detents, until released by rotation of the cylinder and spline. When the tooth is retracted from the detent notch with which it is engaged, the entire lock body is freely shiftable on the bars toward and away from the cabinet side wall. The detent notches and tooth have corresponding inclined faces to provide a ratchet action for the lock body when moving in one direction toward the wall. When the lock body moves in the opposite direction away from the wall, engagement of the tooth in any one of the notches will positively lock the body against further movement away from the wall.

The lock assembly further comprises a rigid locking member, arm adapted in the active position to overlie the cabinet door to block the opening thereof. The arm is parallel to the line of movement of the lock body and therefore parallel to the bars. It is spaced forwardly of the lock body and joined thereto at its inner end by a short connecting portion, which is rigid with the lock body. When in a locking position relative to the cabinet door, the leading end of the arm is well ahead of the mounting plate and projecting inwardly of cabinet side wall. When retracted to a door release position, the arm is clear of the swinging vertical edge of the door and the lock body is near or against the retainer rings.

The most important deficiencies are: this lock has the sufficiently extended and significantly sharp (unsafe, e.g., for children) parts of the lock (e.g., such as a pair of directors). Also, the lock requires the resiliently compressible-pullable manual actions, which may be not conveniently possible for the elderly or ill persons, and complex (requires the special properly designed key, etc.).

Referring to the mentioned hereinabove cabinet lock by U.S. Pat. No. 6,874,825, the locking assembly includes a panel having a first side and a second side. The first side has a pressure sensitive adhesive thereon for selectively attaching the first side to a vertical surface adjacent to a cabinet drawer or cabinet door. A post is attached to and extends away from the second side of the panel. The post has a terminal end and a peripheral lip is attached to and extends along a length of the terminal end. A plate has an inner surface and an outer surface. A sleeve is attached to and extends away from the inner surface. The sleeve has a free end having a well extending therein. An inwardly extending peripheral flange is attached to the free end. The terminal end of the post is positioned within the sleeve. The plate is selectively positionable over the drawer (door). A biasing member is positioned within the well and biases the lip away from the flange. The biasing member is a compression spring. A locking assembly is adapted for selectively allowing rotation of the post with respect to the sleeve.

The locking assembly also includes a plurality of notches extending into the peripheral lip. A plurality of teeth is attached to an inner surface of the well. The teeth are positioned generally between the flange and a bottom wall of the well. The teeth are positioned for engaging the notches when the terminal end is positioned between the flange and the bottom wall. A resiliently compressible member is attached to the bottom wall. The resiliently compressible member is comprised of a foamed rubber or other elastomeric material. The teeth engage the notches when the terminal end is abutting the compressible member to prevent rotation of the sleeve. Alternate locking mechanisms, that require pressure on the plate in order to turn the plate, may also be used by including a conventional child safety caps, mostly used on medicine bottles or the like. This locking assembly operates as follows: the panel is attached to the vertical surface adjacent to a drawer (e.g., the front panel of the cabinet), so that the plate may be moved over an edge of the drawer (or door opening). In this position, the drawer (door) is locked in a closed position. The biasing member keeps the teeth in the notches so that the plate may not be rotated. In order to rotate the plate away from the drawer/door, the plate is pressed inward so that the teeth are disengaged with the notches and the sleeve is allowed to rotate. A rigid cover is positioned between the compressible material and the terminal end to aid in the rotation of the sleeve.

The most important deficiencies are: this lock requires the resiliently compressible-pullable manual actions, which may be not conveniently possible for elderly or ill persons, and is complex too.

Another locking device is described in the U.S. Pat. No. 6,695,507. The principles of this lock, intended for securing the cartridge door in the printer, can be fully applied to the cabinet door(s). The lock system by this patent includes a lock housing and a base portion which is used for attaching the lock housing onto the printer adjacent its printer door. The base portion has a base surface which is directly attached to the printer body. The base surface is adhered to the printer body, for example, by glue. Also, the lock housing has a lateral aperture therethrough. The lateral aperture is formed in a manner as to extend in a generally parallel relationship with respect to the closed printer door when the base surface of the lock housing is attached to the printer body. Slidably disposed within the lateral aperture is an elongated locking member, which is an elongated bar extending beyond the length of the lateral aperture. When no physical restraint is placed upon the locking member, the locking member freely slides along the lateral aperture between a lock position and an unlock position. The locking member can move along the lateral aperture between the two possible positions by operator. One of the lock position is formed when the locking member manually slides towards the printer door so that a portion thereof extends over and block the door from opening. The portion of the locking member which extends over the door is defined as a locking portion. When the locking member manually slides in an opposite direction (away from the printer door), the unlock position is formed whereat the locking portion is substantially retracted within the lateral aperture. The locking member defines a locking end (disposed toward the door) and an unlocking end (disposed away from the door). The locking and unlocking ends are each provided with a stoppers which are essentially protrusions that extend vertically upward relative to their respective ends. The stoppers are formed to extend sidewardly with respect to the locking and unlocking ends. Regardless of their extension, the stoppers 38 are designed to abut respective portions of the lock housing for the purpose of confining the slidability of the locking member between the lock and unlock positions. Actually, the stopper formed at the unlocking end engages the adjacent side housing surface of the lock housing in abutting contact to prevent the locking member from sliding out of the lateral aperture beyond the lock position. In the same manner, the stopper at the locking end engages the adjacent side housing surface in abutting contact to also prevent the locking member from sliding out beyond the unlock position.

The lock device is adapted to maintain the locking member in the lock position, and it is provided within the lock housing. The lock device comprises an embedded device portion and an exposed device portion. The embedded device portion of the lock device is embedded within the lock housing while its exposed device portion is exposed outside thereof. A longitudinal aperture is provided within the lock device which extends longitudinally between the exposed device portion and the embedded device portion. This aperture operates with the lateral aperture and forms a perpendicular relationship therewith. A stationary support surface is engaged to the lock device's internal device surface so as to be disposed within the longitudinal aperture about the embedded device portion of the lock device within the longitudinal aperture through the support surface of an engaging member, having a lower engaging portion and an upper engaging portion. The engaging member is a cylindrical rod. The engaging member is movable along the longitudinal aperture between a disengaging position and an engaging position. In the disengaging position, the lower engaging portion of the engaging member is substantially retracted within the longitudinal aperture, whereby the upper engaging portion is protruded out of the exposed device portion. The engaging member is a spring loaded so that it is naturally biased in the disengaging position. To provide the engaging position, the upper engaging portion is manually pushed into the longitudinal aperture which in turn causes the lower engaging portion to extend into the lateral aperture. For such extension, the locking member is placed in the lock position where it provides an arcuate notch, which aligns with and receives the lower engaging portion therethrough. The arcuate notch is sized as to securely maintain the lower engaging portion therewithin, and the locking member becomes immovable by the insertion of the lower engaging portion.

The most important deficiencies are: the locking assembly requires the resiliently compressible-pullable manual actions, which may be not conveniently possible for the elderly or ill persons, and is complex too.

Next known lock is a rotating-lock closure with traction unit by U.S. Pat. No. 6,568,226. This closure comprises a closure housing, which has a flange on one end, a rotating-lock passed through a passageway in a wall, a door leaf or a wall-closing flap, which matches the outside cross section of the housing (for example, rounded with flattened portions spaced at 90° from each other). They can be fixed in this position by means of a union nut, a retaining clip, cap screws, holding springs protruding from the housing wall. A union nut is screwed onto an outside thread attached to the outside surface of the housing. To secure the housing against rotating inside the wall, the housing has at least one flattened portion which works in conjunction with a corresponding chordlike constriction of the associated passageway and secures the housing against rotation inside the passageway. Four flattened portions offset from each other by 90° are provided so that the housing can be fitted in four positions, each representing a rotation of 90°. Correspondingly, the passageway in the wall has four such chordlike constrictions. The housing has a bearing area which is arranged in a direction coaxial to the housing axis and which is open towards the flange and the receiving head for receiving an operating element, like a socket key. Adjacent to this first bearing area in the housing is located a second bearing area which receives the lock driving support, providing an axial and sliding displacement and rotation, and supporting the rotating-lock. A shaft with a rounded cross section extends from the head which first passes through a corresponding rounded borehole in the dividing wall, separating the first and second bearing areas, and then through a corresponding borehole in the lock driving support. The driving support at its end forms a transverse passageway through which a cam pin is inserted, the ends of which are being supported on a cam track formed on and around the outward-facing surface of the borehole of the rotating-lock. The lock driving support has a non-rounded peripheral surface. The passageway of a circular form is narrowed by two chordlike constrictions. The housing permits a rotational movement of 90° of the lock driving support in its position between housing and tongue of rotating-lock.

A spiral pressure spring, arranged in the second bearing area, supports itself on one side on the dividing wall of the housing, and on another side it pushes against the front of the lock driving support. Further, the rotating-lock pushes its cam track against the transverse pin. At first, the key is inserted in the receiving head, then the key is turned counterclockwise. After overcoming a small amount of resistance (lifting of the cam pin from the small indentation), which means displacing the tongue against the force of the spring by about 0.5 mm, the cam pin subsequently slides downward until it reaches the stop point. Because of the pressure of the spring, the lock moves outwards by a travel distance of, for example, 6 mm during this movement without being able to rotate inside the housing.

The lock has multiple stop positions under 90° of rotation to provide the locked or open actions by the key. When the cam pin at the top end of this shaft moves slidingly from a lowest point to a highest point, the pin slides along the cam surface and pushes the lock downwards by the travel distance until the rotating-lock reaching the appropriate position, in which the lock pushes against a rear engaging surface formed, for example, by the housing of a cabinet and keeps the door in a closed position fitting closely to the door frame.

The installation is provided from behind through a passageway and significantly depends upon thickness of the wall by its flange, until the front face of the flange is flush with the front wall surface of the wall. The housing is held by a nut on the rear end of the housing, which in turn is held by a plate suitably attached to the rear side of the wall; and the plate has projections with passageways through which screws extend into the wall. The nut have projections with passageways through which attachment screws passes so that the nut can be fixed on the cabinet wall. The end of the operating shaft facing away from the operating head supports cam pins sliding in cam tracks while under pressure from a spiral spring arranged between the holding plate and the lock.

The most important deficiencies are: the lock requires the resiliently compressible-pullable manual actions, which may be not conveniently possible for the elderly or ill persons, requires a key, and is complex too, that increases production costs and laborious assembly.

There are much more locking devices have been described in the various inventions. For example, modern U.S. Pat. No. 8,152,208 discloses the panel lock mounted on the cabinet base in the cabinet door's area. The lock comprises a blocker-support base, a panel-movement blocker, and a blocker-arm anchor. Blocker-support base is adapted to mount on the cabinet base's frame in a stationary position near the door. Panel-movement blocker is mounted on blocker-support base to be rotated around a rotation axis between a panel-locking positions, and is arranged to block movement of panel (cabinet door) to keep door in mating contact with the cabinet base and a panel-unlocking position, and the panel-movement blocker is arranged to allow movement of panel out of mating contact with the cabinet base. Blocker-arm anchor includes a rotation lock which includes a retainer ring and a retainer-ring receiver. Retainer ring is coupled to panel-movement blocker and is configured to move from a rotation-blocking position toward a rotation-unblocking position. When rotation lock is in the rotation-blocking position, retainer ring is arranged to mate with retainer-ring receiver that is appended to blocker-support base. When retainer ring is in the rotation-unblocking position, retainer ring is positioned to lie in spaced-apart relation to retainer-ring receiver. Blocker-arm anchor also includes a rotation-lock actuator configured to provide means for moving retainer ring out of mating contact with retainer-ring receiver to free panel-movement blocker to rotate about rotation axis in response to a user-applied rotation torque applied during movement of panel-movement blocker from the panel-locking position toward the panel-unlocking position. Rotation-lock actuator includes a rotation-lock release button and a button-return spring. Rotation-lock release button is coupled to panel-movement blocker to rotate about rotation axis with panel-movement blocker.

Rotation-lock release button is coupled to retainer ring to move as a unit from the rotation-blocking position toward the rotation-unblocking position by moving in an actuation direction parallel to rotation axis toward blocker-support base. Button-return spring is arranged to provide a biasing force to rotation-lock release button to urge rotation-lock release button to assume the rotation-blocking position. The retainer-ring receiver includes a circular band appended to blocker-support base. Circular band is arranged to extend away from panel-movement blocker and to include an inner-bearing surface, an outer-band surface, and a retainer-ring rotation surface. Inner-bearing surface is positioned to lie at first distance from rotation axis and is arranged to face toward rotation axis. Outer-band surface is positioned to lie at relatively larger second distance from rotation axis and is arranged to face away from rotation axis. Retainer-ring rotation surface is arranged to extend between inner-bearing surface and outer-band surface, and is arranged to face away from panel-movement blocker. Retainer ring of rotation lock is formed to include an inner-ring surface and an outer-ring surface. Inner-ring surface is positioned to lie at third distance from rotation axis and is arranged to face toward rotation axis. Outer-ring surface is positioned to lie at relatively larger fourth distance from rotation axis and is arranged to face away from rotation axis. The outer-ring surface of retainer ring is arranged to lie in confronting relation with inner-bearing surface of retainer-ring receiver upon movement of retainer ring to the rotation-blocking position. Retainer ring also includes a first blocking tab, a second blocking tab, and a third blocking tab. Each blocking tab is appended to outer-ring surface and is arranged to extend away from rotation axis.

Second blocking tab is positioned to lie in spaced-apart relation to first blocking tab and third blocking tab is positioned to lie in spaced-apart relation from first and second blocking tabs. The blocking tabs are positioned in circumferentially spaced-apart relation to one another at 120° intervals around retainer ring. Retainer-ring receiver is formed to include a first tab-receiving notch a second tab-receiving notch, and a third tab-receiving notch. Each tab-receiving notch is arranged to receive each companion blocking tab appended to retainer ring upon movement of retainer ring to the rotation-blocking position. Upon movement of retainer ring to the rotation-unblocking position each blocking tab is arranged to ride on retainer-ring rotation surface as panel-movement blocker moves from the panel-locking position toward the panel-unlocking position. The panel-movement blocker is formed to include illustratively a first post-receiving aperture, a second-post-receiving aperture, and a third post-receiving aperture. Each post-receiving aperture is positioned to lie at first radial distance from rotation axis. Rotation-lock release button of rotation-lock actuator includes a button grip, a first button post, a second button post, and a third button post. Each button post is appended to button grip and arranged to extend through each companion post-receiving aperture and is coupled to retainer ring. Retainer ring is coupled to post-receiving apertures by a set of arm-lock fasteners. Blocker-support base of lock includes a carrier foundation, a foundation fastener, and a blocker carrier. Foundation fastener is adapted to interconnect carrier foundation to the cabinet. Foundation fastener is a double-sided adhesive pad. Blocker carrier is coupled to carrier foundation by a set of carrier-foundation fasteners, (screws), and a blocker carrier is configured to support panel-movement blocker. Panel-movement blocker operates to block movement of panel between the opened position and the closed position. Panel-movement blocker includes an arm-support hub and an arm pivot. Arm-support hub is arranged to extend toward carrier foundation, and arm pivot is coupled with arm-support hub. Arm pivot is arranged to extend along rotation axis toward carrier foundation. Arm-support hub is configured to mate with blocker carrier to allow rotation of arm-support hub relative to blocker carrier. Arm pivot includes a support shaft, a pivot axle, and a rotation-stop wall. Support shaft is appended to arm-support hub and is positioned to lie along rotation axis. Pivot axle is appended to support shaft and positioned to lie along rotation axis. Rotation-stop wall is appended to support shaft and arranged to extend toward carrier foundation. Rotation-stop wall is positioned to lie in spaced-apart relation to pivot axle to define an arm-pivot-receiver space therebetween. Carrier foundation includes an arm-pivot receiver, arranged to extend toward panel-movement blocker to mate with arm pivot and a blocker-stop tab. Arm-pivot receiver and arm pivot cooperate to cause panel-movement blocker to rotate about rotation axis upon movement of rotation lock to the rotation-blocking position and to the rotation-unblocking position. Blocker-stop tab is appended to arm-pivot receiver and is arranged to extend away from rotation axis. Blocker-stop tab is configured to mate with rotation-stop wall included in arm pivot to block rotation of panel-movement blocker after moving to the panel-unlocking position. Carrier foundation also includes a pivot fastener which interconnects with pivot, and together with arm-pivot receiver together to allow rotation of blocker are 94 to rotate about rotation arm relative to carrier foundation. Panel-movement blocker further includes a blocker-arm. Blocker return operates to bias panel-movement blocker to the panel-locking position after movement by a user to the panel-unlocking position. Blocker return also includes a blocker-return spring, a clockwise-stop wall, and a counter-clockwise stop wall. Clockwise-stop wall and counter-clockwise-stop wall are appended to a semi-circular pivot guide wall. The counter-clockwise-stop wall is appended to a first end of pivot guide wall, and clockwise-stop wall is appended to an opposite second end of pivot guide wall. Both counter-clockwise-stop wall and clockwise-stop wall are configured to mate with blocker-return spring when panel-movement blocker is in the panel-unblocking position. Blocker arm includes arm-support hub and a blocker appendage. Blocker appendage is appended to arm-support hub to move therewith. Blocker appendage is arranged to extend away from rotation axis and toward panel when panel-movement. Arm-support hub of panel-movement blocker can be formed to include first post-receiving aperture, second-post-receiving aperture, and third post-receiving aperture.

The most important deficiencies are: the lock requires the resiliently compressible-pullable manual actions, which may be not conveniently possible for the elderly or ill persons, requires a key, and is complex too, that increases production costs and laborious assembly.

All cabinet locking devices, described hereinabove, contain the springs, unable to control (to regulate) the tightness of the closed cabinet door to the cabinet base, are complex, expensive (increased production costs and laborious assembly/installation), and require the resiliently compressible-pullable manual actions, which may be not conveniently possible for the elderly or ill persons. Also some of the known devices require the use of the key, it is highly inconvenient.

SUMMARY

In view of the foregoing disadvantages inherent in the known prior art, the present invention provides many advantages of the improved cabinet locking device. One of the advantages is: the improved cabinet locking device does not include any sprigs, which require the use of the resiliently compressible-pullable manual actions, which may be not conveniently possible for the elderly or ill persons, and the improved cabinet locking device configured also to successfully work with the cabinet doors intended to lie flush with a cabinet base.

Illustratively in general, a cabinet can include a cabinet door locking device and a cabinet drawer locking device. The cabinet door locking device and cabinet drawer locking device are the analogous locking devices. The cabinet comprises a cabinet door locking device, a cabinet drawer locking device, a cabinet front wall (panel), a cabinet door, a cabinet drawer, a cabinet drawer front panel (wall), a cabinet shelf, a cabinet door first hinge, a cabinet door second hinge, a cabinet door handle, a cabinet drawer handle, a plates and a cabinet base. The plates are intended to protect the cabinet door outer surface (which could be molded or painted) from the possible scratches or other damages made by the locking member head of the locking member during locking-unlocking operations.

Also, the cabinet front panel of the cabinet comprises a cabinet door opening. The screw bushing comprises an inner thread, an outer thread and a spline. The locking member also includes an extended portion which comprises an outer thread. The thickness of the locking member head can be the same as the diameter of the extended portion, or the locking member head can have the reasonably less thickness or the thickness of the locking member head can be bigger than the diameter of the extended portion.

The screw bushing can be inserted (screwed) into the cabinet base in any conveniently selected place in the area of the opening edge of the cabinet door opening. The screw bushing insertion (installation) at selected place is provided by drilling the aperture in the cabinet base near the opening edge. Using a flat screwdriver and spline in the screw bushing, the screw bushing is screwed inside the aperture. The locking member by its outer thread of the extended portion is coupled with the inner thread of the screw bushing. The tightness of the closed position of the cabinet door to the cabinet base can be provided by the tighter screwing of the locking member into screw bushing.

Some cabinets use one door opening for two cabinet doors: Such cabinets usually include a vertical cross bar. For such cabinets, comprising the vertical cross bar, the aperture can be drilled in the vertical cross bar and the screw busing can be inserted (installed) in that aperture. A first projection and a second projections of the locking member head can be appropriately use for keeping the first and second cabinet doors in the doors' closed positions. If the use of only one cabinet door locking device for both doors is not convenient, than two locking devices can be used: one locking device for one door and another locking device for the second door. If the cabinet does not include the vertical cross bar, than the screw busing can be installed in the front edge of the shelf, and the first projection and a second projections of the locking member head can be appropriately used for keeping both doors in the cabinet doors' closed positions.

With respect to the above description then, it is to be realized that the optimum dimensional relationships for the parts of the invention, to include variations in size, materials, configurations, shape, form, function and manner of operation, assembly and use, are deemed readily apparent and obvious to one skilled in the art, and all equivalent relationships to those illustrated in the drawings and described in the specification are intended to be encompassed by the present invention.

Any and all additional modifications and improvements of the present invention may also be apparent to those of ordinary skill in the art. Thus, the particular combination of parts described and illustrated herein is intended to represent only certain embodiments of the present invention, and is not intended to serve as limitations of alternative devices within the spirit and scope of the invention.

The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed. Additional features of the present disclosure will become apparent to those skilled in the art upon consideration of illustrative embodiments exemplifying the best mode of carrying out the disclosure as presently perceived.

BRIEF DESCRIPTION OF THE DRAWING

In order that the invention and the manner in which it is to be performed can be more clearly understood, embodiments thereof will be described by way of example with reference to the attached drawings, the detailed description of which particularly refers to the accompanying figures in which:

FIG. 7A is a simplified drawing of the first variant of the locking member.

FIG. 7B is a simplified drawing of the second variant of the locking member.

FIG. 7C is a simplified drawing of the third variant of the locking member.

FIG. 7D is a cross-section 38-38 of the locking member head of the third variant of the locking member.

THE DRAWING REFERENCE NUMERALS

Figure 1:
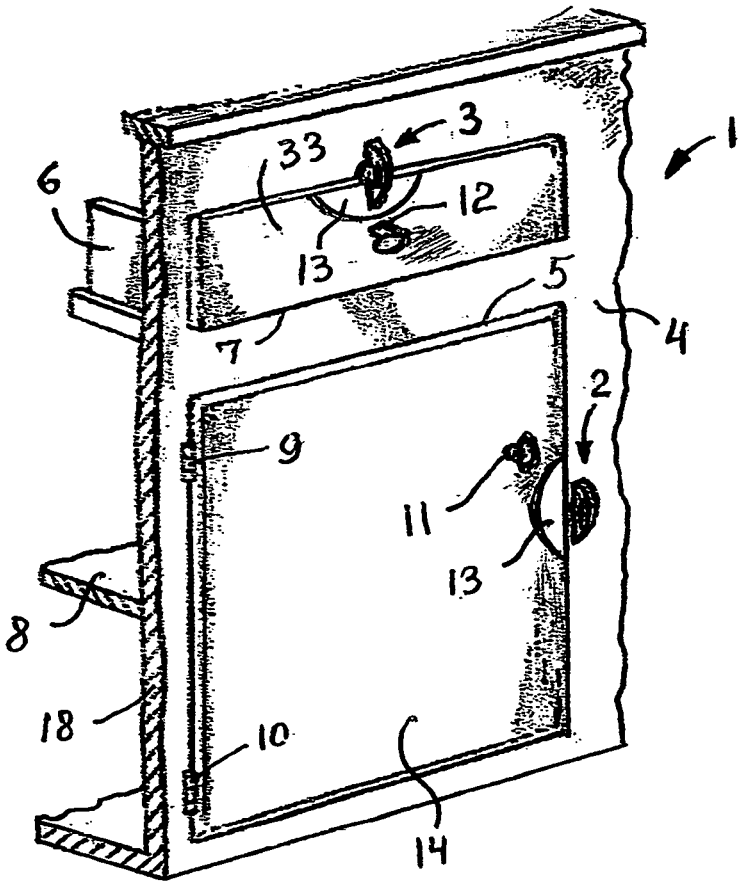
FIG. 1 is a spatial view of the cabinet assembly.

1—a cabinet;
2—a cabinet door locking device;
3—a cabinet drawer locking device;
4—a cabinet front wall (panel);
5—a cabinet door;
6—a cabinet drawer;
7—a cabinet drawer front wall (panel);
8—a cabinet shelf;
9—a cabinet door first hinge;
10—a cabinet door second hinge;
11—a cabinet door handle;
12—a cabinet drawer handle;
13—a plate;
14—a cabinet door outer surface;
15—a locking member head;
16—a locking member;
17—a cabinet door opening;
18—a cabinet base;
19—a screw bushing;
20—an outer thread of the screw bushing 19;
21—a spline;
22—an inner thread of the screw bushing 19;
23—an extended portion;
24—an outer thread of the extended portion 23;
25—an opening edge;
26—an aperture;
27—a first cabinet door;
28—a second cabinet door;
29—a vertical cross bar;
30—a first projection of the locking member head 15;
31—a second projection of the locking member head 15;
32—a front edge of the cabinet shelf 8;
33—a cabinet drawer outer surface;
34—a left-hand thread;
35—a right-hand thread;
36-36—a vertical cross-section of the screw bushing 19;
37-37—another vertical cross-section of the screw bushing 19;
38-38—a cross-section of the locking member head 15 of the third variant of the locking member 16.

DETAILED DESCRIPTION

A cabinet 1 with a cabinet door locking device 2 and a cabinet drawer locking device 3, in accordance with the present disclosure, is shown in in FIG. 1. The cabinet door locking device 2 and cabinet drawer locking device 3 are the analogous locking devices. The cabinet 1 comprises a cabinet door locking device 2, a cabinet drawer locking device 3, a cabinet front wall (panel) 4, a cabinet door 5, a cabinet drawer 6, a cabinet drawer front panel (wall) 7, a cabinet shelf 8, a cabinet door first hinge 9 and a cabinet door second hinge 10 in order to provide the cabinet door 5 swinging (pivotable) movements, a cabinet door handle 11, a cabinet drawer handle 12, a plate 13 and a cabinet base 18. The plates 13, conventionally shown in FIG. 1, are intended to protect a cabinet door outer (front) surface 14 or the cabinet drawer outer (front) surface 33 (which could be molded or painted) from the possible scratches or other damages made by the locking member head 15 (shown in FIGS. 7A, 7B and 8) of the locking member 16 during locking-unlocking operations. It is understandable, that cabinet door locking device 2 and the cabinet drawer locking device 3 can be identical or can have different configurations, shapes (forms), sizes, etc.

Figure 2:
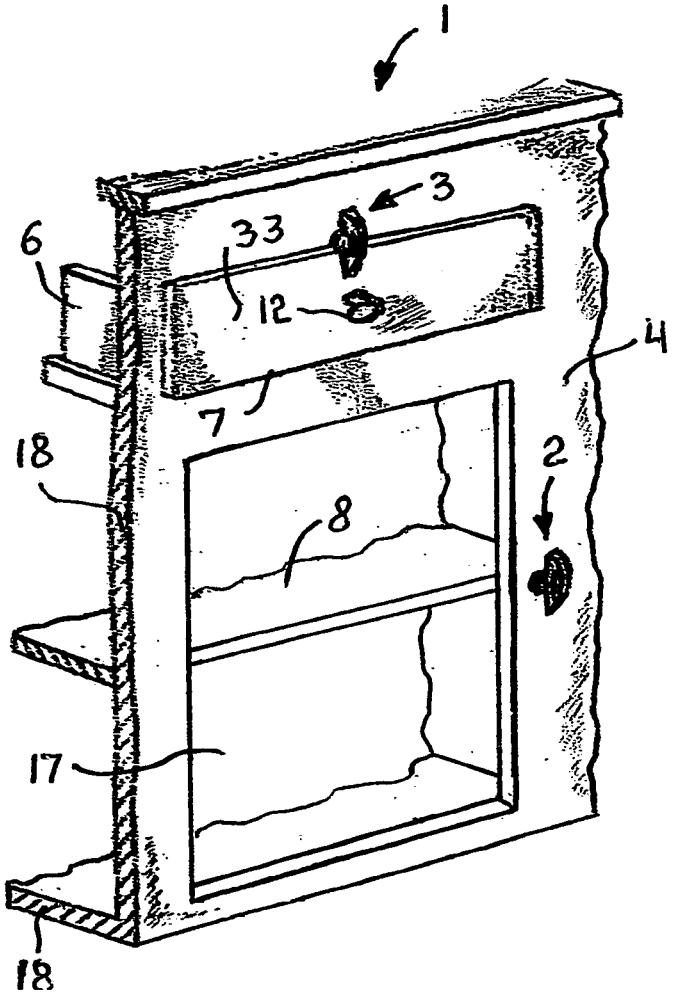
FIG. 2 is a spatial view of the cabinet without cabinet door.

FIG. 2 illustrates the cabinet 1 without the cabinet door 5 and without the first 9 and second 10 hinges and plate 13 on the drawer outer surface 33. In FIG. 2, the plate 13 is conventionally not shown in order to demonstrate that the plates can be not installed on the cabinet doors and/or drawers, as it can be found in the all prior art patents briefly described hereinabove in the background chapter. As shown in FIG. 2, the cabinet front panel 4 of the cabinet 1 comprises a cabinet door opening 17.

Figure 3:
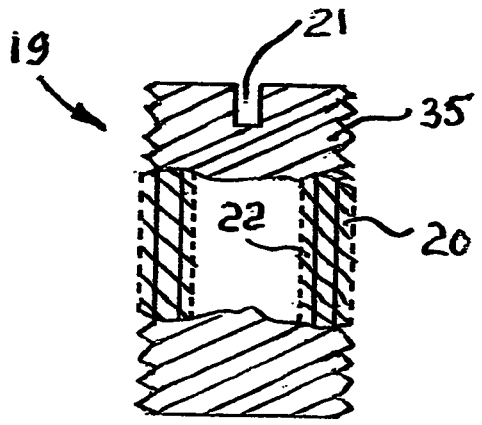
FIG. 3 is a simplified drawing of the screw bushing.
Figure 4:
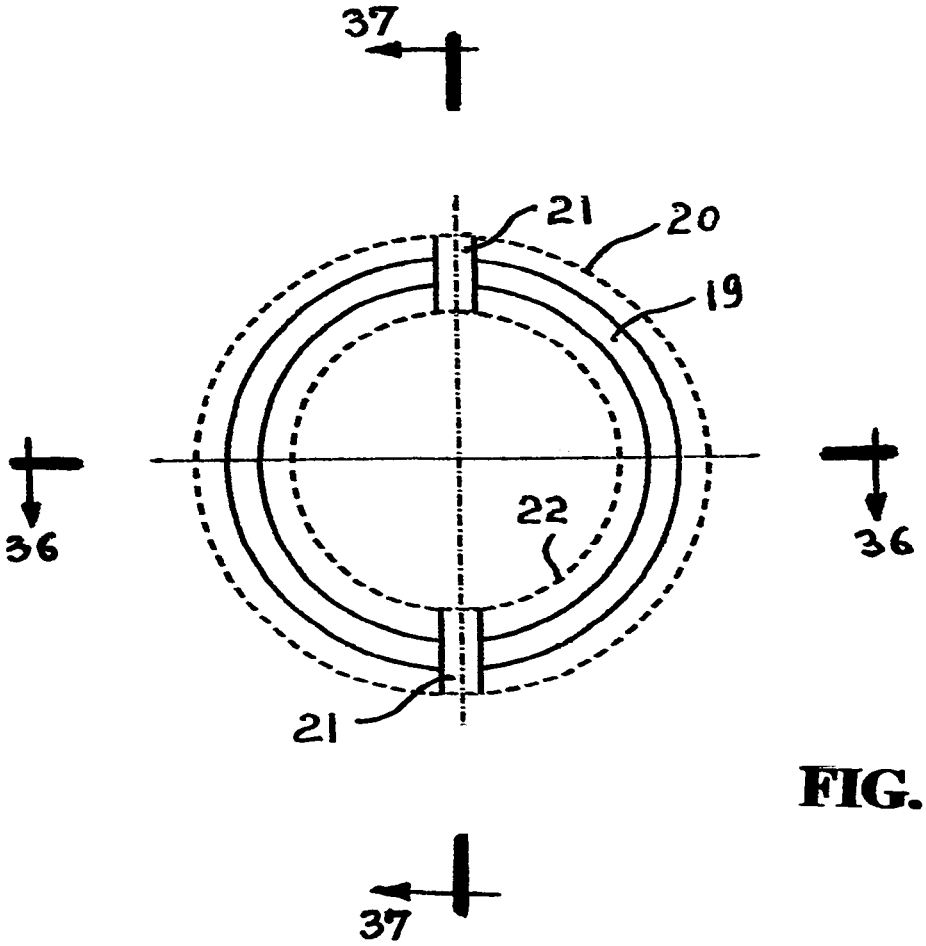
FIG. 4 is a top view of the screw bushing.
Figure 5:
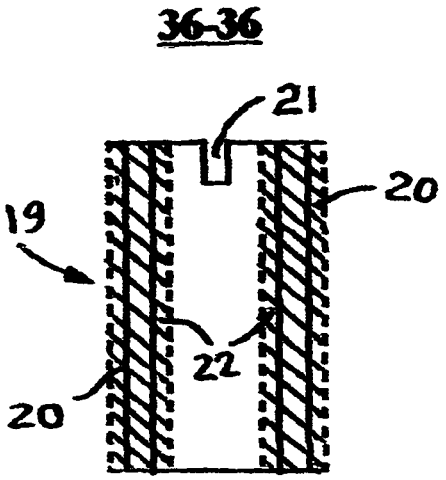
FIG. 5 is a vertical cross-section 36-36 of the screw bushing.
Figure 6:
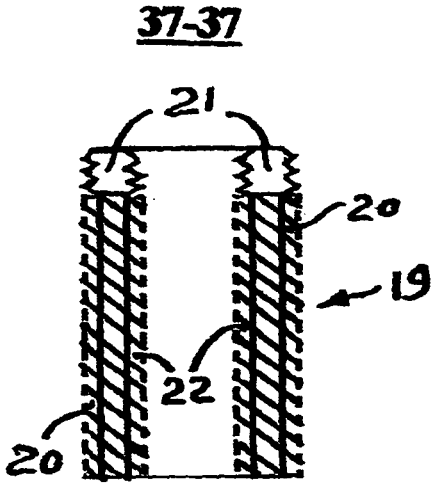
FIG. 6 is another vertical cross-section 37-37 of the screw bushing.

FIG. 3 illustrates a screw bushing 19. According to this front view, the screw bushing 19 comprises an outer thread 20 (a screw busing outer thread 20), an inner thread 22 (a screw busing inner thread 22), and spline 21, which are also shown in FIGS. 4, 5, 6 and 8.

FIG. 7A depicts the locking member 16, which in addition to the locking member head 15 also includes an extended portion 23 which comprises an outer thread 24 (an extended portion outer thread 24). The locking member 16 is conventionally presented in FIGS. 7A-7C and 8 as a solid piece (entire element having two non-separate portions: the extended portion 23 and locking member head 15), but the locking member 16 can comprise at least two separate portions (not shown): a portion of the locking member head 15 and a separate extended portion 23 (e.g., such as a bolt—not shown) rigidly attached to that locking member head 15. The thickness of the locking member head 15 can be the same as the diameter of the extended portion 23, or the locking member head 15 can have the reasonably less thickness (not shown), and the presented drawings do not and should not limit the thickness of the locking member head 15 [for example, the thickness of the locking member head 15 can be bigger (not shown) than the diameter (including outer thread 24) of the extended portion 23]. The locking member head 15 can have any reasonably convenient thickness, as well as the configuration, shape and form, for example, according to FIGS. 7A-7C. The one of many possible cross-sections of the locking member head 15 is shown in FIG. 7C, wherein the locking member head 15 is presented as of a circular configuration, and the cross-section of the locking member head 15 can be not only of the circular configuration, as shown in FIG. 7D, but also of a flat configuration (not shown), etc. The FIG. 7B depicts the locking member head 15, wherein the lower edge of the head 15 has a rounded configuration.

Figure 8:
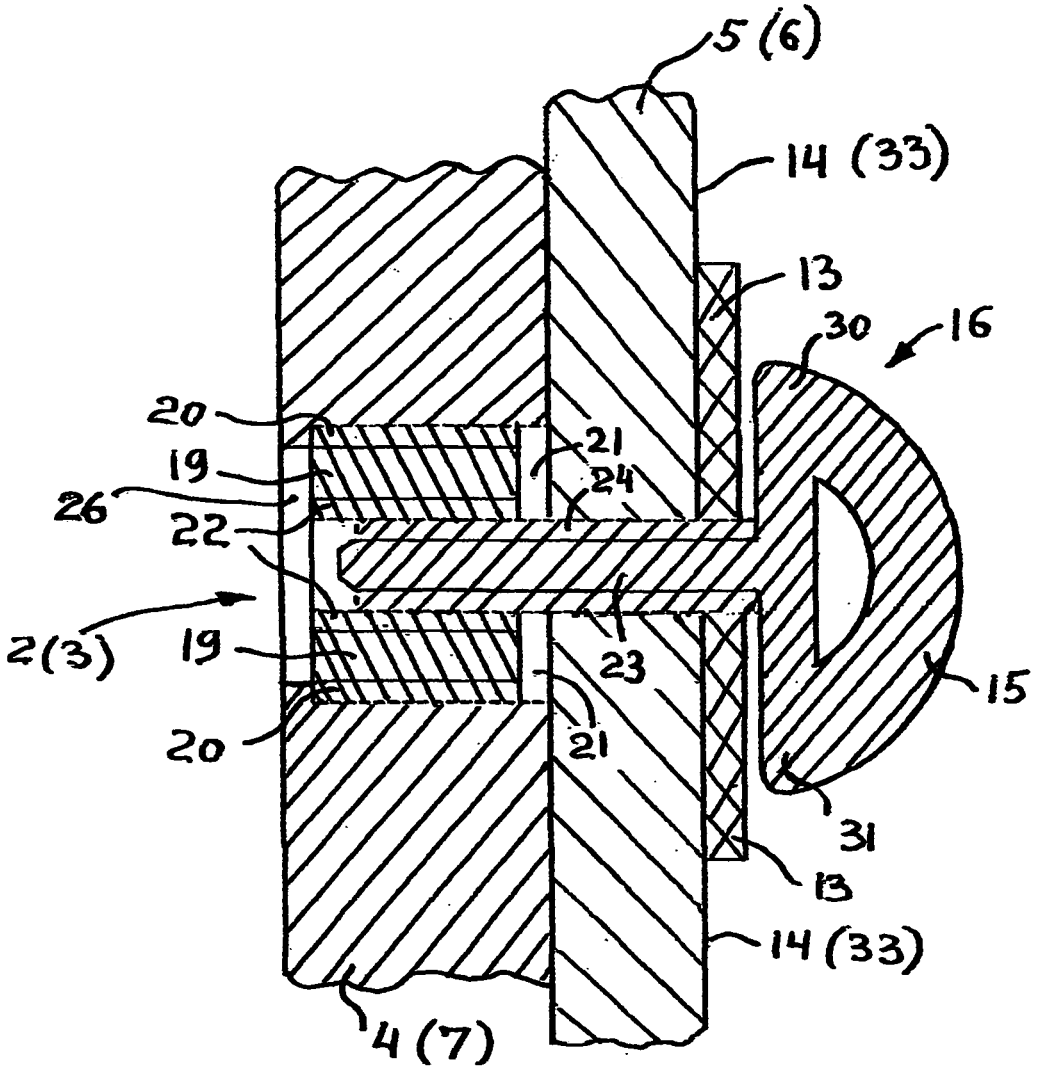
FIG. 8 is a simplified drawing of the installed locking device assembly.

The screw bushing 19 can be inserted (screwed) into the cabinet base 18 in any conveniently selected place in the area of the opening edge 25 of the cabinet door opening 17. The screw bushing 19 insertion (installation) at selected place is provided by drilling the aperture 26 in the cabinet base 18 near the opening edge 25. Using a flat screwdriver (not shown) and spline 21, the screw bushing 19 is screwed inside the aperture 26. Referring to FIG. 8, the diameter of aperture 26 should be accordingly corresponding to the outer thread 24 of the extended portion 23 of the locking member 16. The locking member 16 by its outer thread 24 of the extended portion 23 is coupled with the inner thread 22 of the screw bushing 19. The tightness of the closed position of the cabinet door 5 to the cabinet base 18 can be provided by the tighter screwing of the locking member 16 into screw bushing 19.

Figure 9:
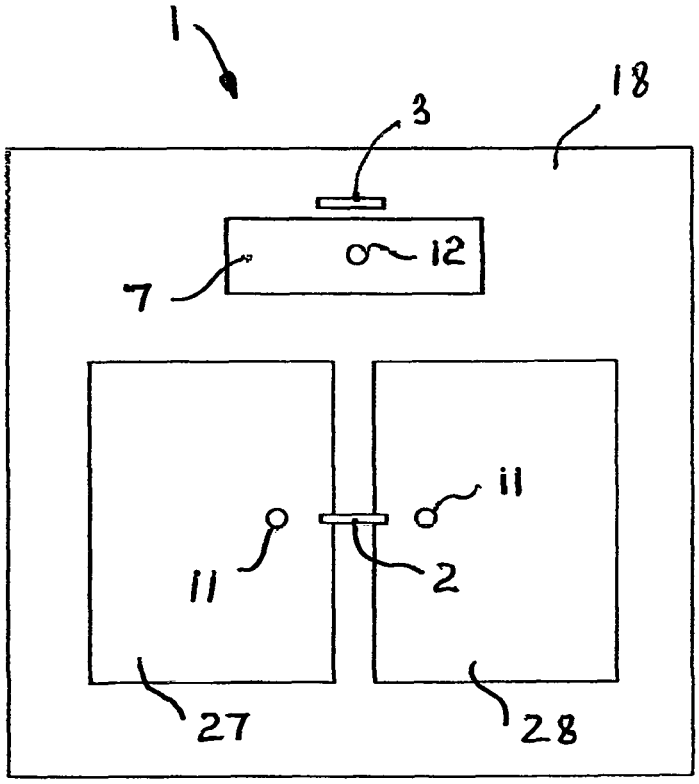
FIG. 9 is a simplified front view of the 2-doors cabinet.

Some cabinets use one door opening 17 for two cabinet doors: a first cabinet door 27 and a second cabinet door 28, for example as it is shown in FIG. 9. In FIG. 9 are conditionally presented the cabinet door locking device 2 in the position when the first cabinet door 27 and a second cabinet door 28 are closed, and a single cabinet door locking device 2 locks both (first 27 and a second 28) cabinet doors. It is understandable, that the first cabinet door 27 and the second cabinet door 28 can have a separate own cabinet locking device 2. The cabinet drawer locking device 3 is conditionally shown in FIG. 9 as in the unlocking position. The plates 13 and hinges are conditionally not shown in FIG. 9. Again, it should be understandable, that all cabinet door locking devices and the cabinet drawer locking devices can be identical or each can have the different configurations, shapes (forms), sizes, etc.

Figure 10:
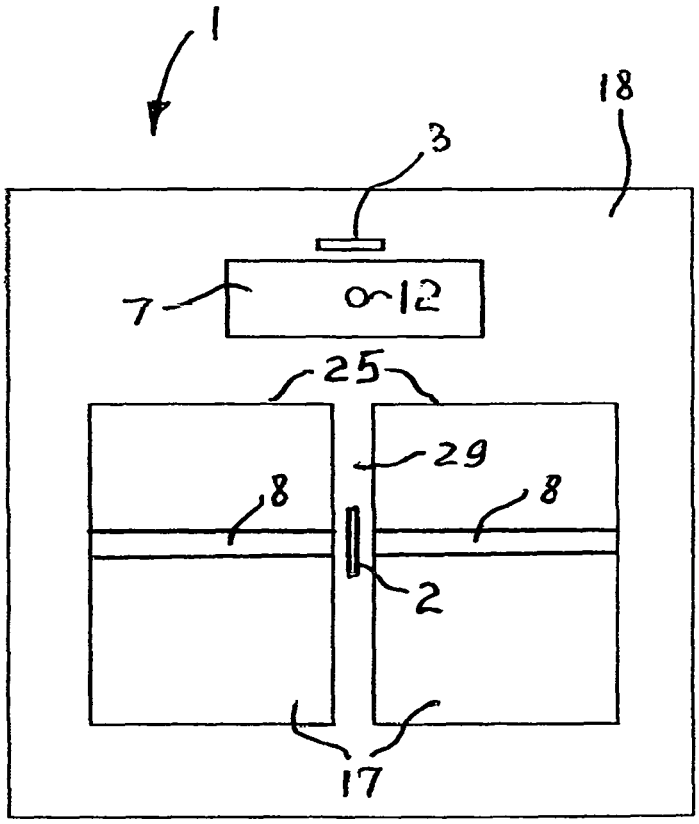
FIG. 10 is a simplified front view of the 2-doors cabinet without doors and with the cabinet base cross-bar.
Figure 11:
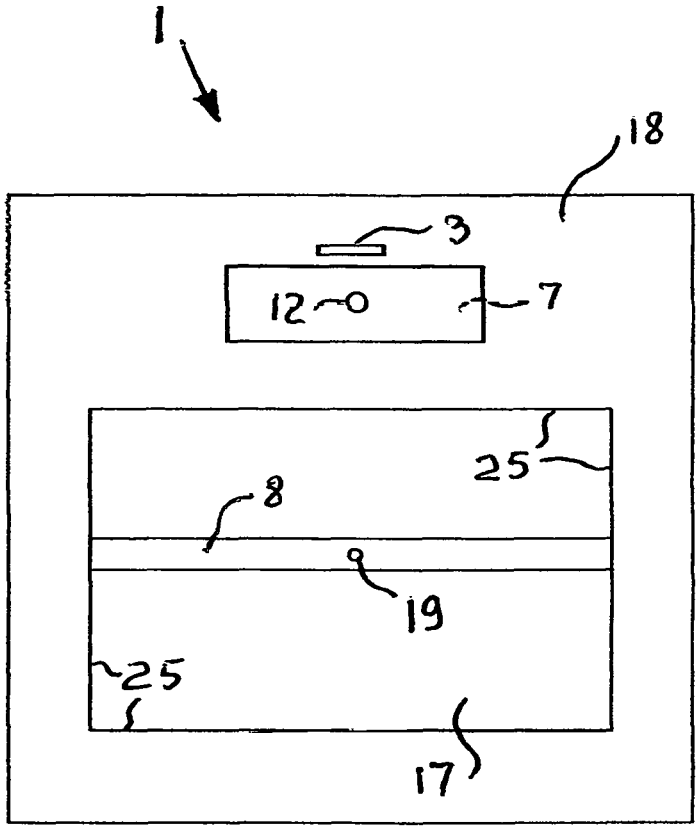
FIG. 11 is a simplified front view of the 2-doors cabinet without doors and without the cabinet base cross-bar.

Such cabinets usually include a vertical cross bar 29, as it is shown in FIG. 10. For such cabinets, comprising the vertical cross bar 29, the aperture 26 can be drilled in the vertical cross bar 29 and the screw busing 19 can be inserted (installed) in that aperture 29. A first projection 30 of the locking member head 15 and a second projection 31 of the locking member head 15 (FIG. 8) can be appropriately use for keeping the first 27 and second 28 cabinet doors in the doors' closed positions (FIG. 9). If the use of only one cabinet door locking device 2 for both (first 27 and second 28) doors is not convenient, than two locking devices can be used (not shown): one lock
for the first door 27 and another lock for the second door 28. If the cabinet does not include the vertical cross bar 29, than the screw busing 19 can be installed in the front edge (panel) 32 of the cabinet shelf 8, as it is shown in FIG. 11, and the first projection 30 and a second projection 31 of the locking member head 15 can be appropriately used for keeping the first 27 and second 28 doors in the cabinet doors' closed positions, as it is shown in FIG. 9. Also, the cabinet locking device for the first 27 and second 28 cabinet doors can be installed (not shown) in the cabinet base 18 in the areas, for example, of the upper or lower edges (not shown) of the first 27 and second 28 doors.

The locking member head 15 can comprise a single projection (not shown) instead of two projections: the first 30 and second 31 projections, as shown in FIGS. 7A, 7B and 8). The locking king member head 15 can be of the circular form, as it is shown in FIG. 7C, with the circular cross-section, as shown in FIG. 7D.

For locking of the cabinet door 5 in the door closed position, the person (operator) rotate the locking member head 15 to the position when the locking member head 15 is in the horizontal position (not shown), and the first projection 30 of locking member head 15 or the second projection 31 of the locking member head 15 is located over the plate 13. The tightness of the cabinet door 5 closed position can be controlled (regulated) by the tightness of the resting of the locking member head 15 on the plate 13.

For locking of the cabinet drawer 6 in the cabinet drawer closed position, The screw bushing 19 can be inserted (screwed) into the cabinet base 18 in any conveniently selected place in the area of the opening edge (not shown) of the cabinet drawer opening (not shown). The screw bushing 19 insertion (installation) at selected place is provided by drilling the aperture 26 in the cabinet base 18 near the opening edge (not shown) of the cabinet drawer opening (not shown). Using a flat screwdriver (not shown) and spline 21, the screw bushing 19 is screwed inside the aperture 26. Referring to FIG. 8, the diameter of aperture 26 should be accordingly corresponding to the outer thread 24 of the extended portion 23 of the locking member 16. The locking member 16 by its outer thread 24 of the extended portion 23 is coupled with the inner thread 22 of the screw bushing 19. The tightness of the closed position of the cabinet drawer 6 to the cabinet base 18 can be provided by the tighter screwing of the locking member 16 into screw bushing 19.

For locking of the cabinet drawer 6 in the drawer closed position, the person (operator) rotate the locking member head 15 to the position when the locking member head 15 is in the vertical position, as it is shown in FIG. 1, and the first projection 30 of locking member head 15 or the second projection 31 of the locking member head 15 is located over the plate 13.

It is understandable, that the threads can be left-hand or right-hand (regular). In FIG. 7A is conditionally (as example) shown the outer thread 24 of the extended portion 23 as a left-hand thread 33, but in FIG. 3 the outer thread 20 of the screw bushing 19 is conditionally (as example) shown as a right-hand thread 34. It is also understandable that if, for example, the outer thread 24 of the extended portion 23 is the left-hand thread, than the inner thread 22 of the screw bushing 19 should be the left-hand thread too.

The padlock can be easily used through the opening (hole) in the head 15 of the locking member 16 and cabinet butt (not shown) additionally installed near the locking member 16.

There are many advantages of the improved cabinet locking device, one of which is: the improved cabinet locking device does not include any sprigs, which require the use of the resiliently compressible-pullable manual actions, which may be not conveniently possible for the elderly or ill persons, and the improved cabinet locking device is configured also to successfully work with the cabinet doors intended to lie flush with a cabinet base (not shown).

The invention claimed is:

1. A cabinet locking device and a cabinet, comprising:

said cabinet having a cabinet door mounted on a cabinet base, said locking device having a screw bushing having an outer surface, an inner surface, and an aperture extending therethrough from a first end to a second end, said locking device including an outer thread on said outer surface of said screw bushing, said locking device further having an inner thread on said inner surface, said locking device further having a spline at a first end and comprising a first slot and a second slot each having a longitudinal axis, said slots located at a first end of said screw bushing and extend from said outer surface to said inner surface of said first end and are located on said first end such that said longitudinal axes are substantially collinear and configured to receive a head of a slotted screwdriver, said cabinet having an aperture drilled in said cabinet base in an area of an edge of an opening for said cabinet door, said cabinet door further having a plate on an exterior surface, said locking device further having a locking member, including an extended portion, said extended portion comprising an outer thread for coupling with said inner thread of said screw bushing, said locking device further having a locking member head having a first projection and a second projection or a circular form, whereby said screw bushing is screwed into said aperture via said spline and said locking member is screwed into said screw bushing, said locking member having a first position where a portion of said locking member head is over said plate and retains said cabinet door in a closed position, said locking member having a second position where said locking member head is rotated so as to not be over said plate and permitting opening of said cabinet door.

2. The cabinet locking device of claim 1, wherein said cabinet comprises a cabinet shelf, wherein said cabinet aperture is drilled in a front edge of said cabinet shelf.

3. The cabinet locking device of claim 1, wherein said cabinet base comprises a cabinet base cross bar, wherein said cabinet aperture is drilled in said cabinet base cross bar.

* * * * *